United States Patent [19]

Corwin et al.

[11] Patent Number: 4,579,370

[45] Date of Patent: Apr. 1, 1986

[54] MULTI-TONE CANCELLATION PHRASE AND BACKGROUND

[75] Inventors: Thomas R. Corwin, Rochester; William H. Mowry, Jr., Ionia, both of N.Y.

[73] Assignee: Burroughs Corporation, Detroit, Mich.

[21] Appl. No.: 626,603

[22] Filed: Jul. 6, 1984

Related U.S. Application Data

[63] Continuation of Ser. No. 416,750, Sep. 10, 1982, abandoned.

[51] Int. Cl.[4] ..... B42D 15/00; B44F 1/12

[52] U.S. Cl. ..... 283/72; 283/93; 283/94; 427/7

[58] Field of Search ..... 283/77, 93, 94, 67, 283/72, 73, 74, 8 B; 282/11.5 A, 27 R, 27 A; 427/7; 355/133

[56] References Cited

U.S. PATENT DOCUMENTS

| | | | |
|---|---|---|---|
| 3,282,720 | 1/1963 | Oleksiw | 427/7 |
| 3,675,948 | 7/1972 | Wicker | 283/93 |
| 4,143,967 | 3/1979 | Wicker | 283/77 |
| 4,175,774 | 11/1979 | Tonges et al. | 283/93 |
| 4,210,346 | 7/1980 | Mowry, Jr. et al. | 283/94 |
| 4,310,180 | 1/1982 | Mowry, Jr. et al. | 283/94 |
| 4,341,404 | 7/1982 | Mowry, Jr. et al. | 283/93 |
| 4,351,547 | 9/1982 | Brooks | 283/93 |

*Primary Examiner*—Paul A. Bell
*Assistant Examiner*—Paul M. Heyrana
*Attorney, Agent, or Firm*—Kevin R. Peterson; Edmund M. Chung; David Rasmussen

[57] ABSTRACT

A protected document has a cancellation phrase, normally invisible to the human eye, which will appear if the document is copied on a color copier. The protection of these documents is improved in the following protected document. The document is made up of a substrate, first and second cancellation phrase images which form a combined cancellation phrase image printed on the substrate, first and second background images forming a combined background image printed on the substrate and a camouflage overlay image (merged with) the combined cancellation and combined background images. The first and second cancellation phrase images appear on the document when it is copied on a color copier. The two images extend the range of protection for color copy machines having multiple darkness settings.

8 Claims, 14 Drawing Figures

LEGEND

A-65 LINE, .010 DOT (TEXT)

B-130 LINE, .005 DOT (BACKGROUND)

C-OPAQUE FILM (WHITE IS BLACK, BLACK IS CLEAR)

LEGEND
A - 65 LINE, .012 DOT (TEXT)
B - 130 LINE, .006 DOT (BACKGROUND)
C - OPAQUE FILM (WHITE WOULD BE BLACK, BLACK WOULD BE CLEAR)

LEGEND
A-65 LINE, .010 DOT (TEXT)
B-130 LINE, .005 DOT (BACKGROUND)
C-65 LINE, .012 DOT (TEXT)
D-130 LINE, .006 DOT (BACKGROUND)

LEGEND
A-65 LINE, .010 DOT (TEXT)
B-130 LINE, .005 DOT (BACKGROUND)
C-65 LINE, .012 DOT (TEXT)
D-130 LINE, .006 DOT (BACKGROUND)
E-CAMOUFLAGE SCREEN (LINE PATTERN B)

MULTI-TONE CANCELLATION PHRASE AND BACKGROUND

This is a continuation of co-pending application Ser. No. 416,750 filed on Sept. 10, 1982, now abandoned.

BACKGROUND OF THE INVENTION

1. Field of the Invention

The present invention relates to protected documents of the color copy resistant type wherein a cancellation phrase appears substantially hidden to the human eye on the original documents, but, which is readily apparent to the casual observer on color copies made of the original.

2. Prior Art

Present protected documents include a cancellation phrase (VOID) of a single tone (includes percent of area covered by dots or other marks and the number of the dots or marks per inch) positioned precisely into a background tone composed of a set of dots or marks significantly different in size and number per inch from that used for the cancellation phrase. Dot sizes and number of lines per inch may be made up of several different combinations such as:

1. Void dots about 0.010 diameter with 65 lines per inch coupled with a background dot of about 0.005 diameter with 130 lines per inch.

Transmission densitometer readings in production grade negatives may be show about 0.65 units for the 0.005 diameter dots.

2. Other combinations such as 62.5 lines per inch for the cancellation phrase and 125 lines per inch for the background also may prove useful. In addition to the dot size combinations set forth in No. 1 above, other variations may also prove useful.

Suitably combined sets of cancellation phrase dots and background dots have been successfully camouflaged by another patterned screen exposed in combination with the phrase and the background screen. Depending on procedure, the resultant photographic film will have dots or marks removed from the phrase and the background or base dots enlarged in the phrase and in the background. This combined film can be used to make printing plates or photographic film copies for distribution to various printing operations.

The above-described system gives good protection against copying to suitably printed documents when copies are made at normal copier settings. However, protection is not complete over the full copier range.

It has been recognized that different dot size pairs (e.g., 65 line, 0.010 diameter and 130 line, 0.005 diameter) have greater or lesser ability to emphasize the cancellation phrase above the background when copied at lighter or darker copier settings.

Efforts to develop a combination of more than a single screen pair have proved aesthetically unsatisfactory despite the fact that the effective range was increased.

The unhappy approach took the form of blocks or bands with one pair of screens per block or band.

All of the cancellation phrases could be camouflaged successfully but the bands or blocks remained and rendered the document unsightly because of the obtrusive background pattern.

The present invention provides a means of combining two or more significantly different background and phrase combinations into a single area on the document thereby avoiding the obtrusive patterns which inevitably result from previous approaches.

BRIEF DESCRIPTION OF THE INVENTION

Object of the Invention

Accordingly, it is an object of the present invention to provide a protected document in which two or more significantly different background and cancellation phrase combinations are combined in a single area of said document.

It is another object of the present invention to provide a protected document in which two separate screen combinations are utilized to prepare said document.

It is also an object of the present invention to provide a protected document in which a first combination of screens includes a first screen capable of producing 65 line, 0.010 diameter phrase dots and a second screen capable of producing 130 line, 0.005 diameter background dots and a second combination of screens which includes a first screen capable of producing 65 line, 0.012 diameter phrase dots and second screen capable of producing 130 lines, 0.006 diameter background dots. A camouflaging pattern which removes about 50% of the area is prepared in both a positive and a negative form and is also included.

It is still a further object of the present invention to provide an improved protected document wherein the four pieces of film described above are combined in a succession of exposures by a pin registration system to give a single piece of film which contains the dual cancellation and background structures.

SUMMARY OF THE INVENTION

In the preferred embodiment of this invention, a method and a means are disclosed which provide an extended range protected document upon which has been introduced two properly selected pairs of dot sizes in both cancellation phrase and background pattern.

An alternative method is also disclosed which introduces two pairs of dot sizes by using an appropriate mask to allow continued exposure in parts of the image while protecting other parts from additional exposure. The continued exposure creates dots different in size from the protected dots but avoids the need for precise double exposure and masking.

DETAILED DESCRIPTION OF THE INVENTION

Figure 1:
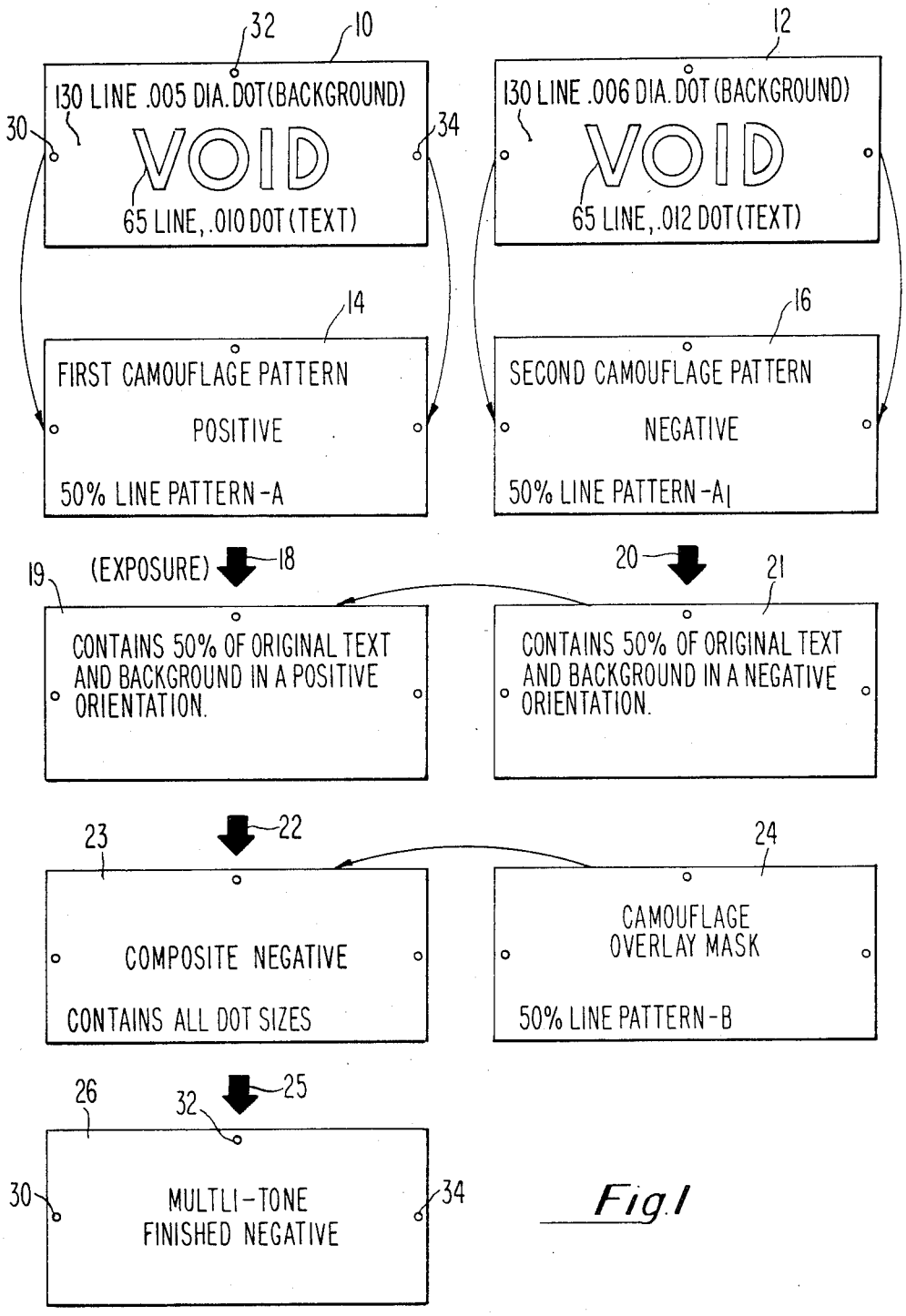
FIG. 1 is a block diagram of the method for producing the extended range protected document.

FIG. 1 is a block diagram showing a general description of the method, steps and system for providing the extended range protected document. The first step of the method requires first and second screen combinations 10 and 12. Screen combination 10 could have 65 line, 0.010 diameter phrase dots and 130 line, 0.005 diameter background dots. Second screen combination 12 might have 65 line, 0.012 diameter phrase dots and 130 line, 0.006 diameter background dots. Other ways can be used to describe the combination in terms of percentages or densities. Any consistent system will do.

A pair of first and second camouflaging patterns 14 and 16 removing about 50% of the area and retaining 50% of the area are prepared in positive and negative form.

The four above pieces of film 10, 12, 14, and 16 may be combined in a succession of exposure 18, 20, and 22 (designated by heavy arrows) to give a single piece of film 23, a composite negative containing the dual phrase and background dot structures. The procedures are similar to those used for color correction masking in process color separation. This process uses a pin register system which depends on holes in the film which fit over pins.

Exposure 25, combines composite negative 23 with camouflage overlay mask 24 to give the multi-tone finished negative 26.

Figure 2:
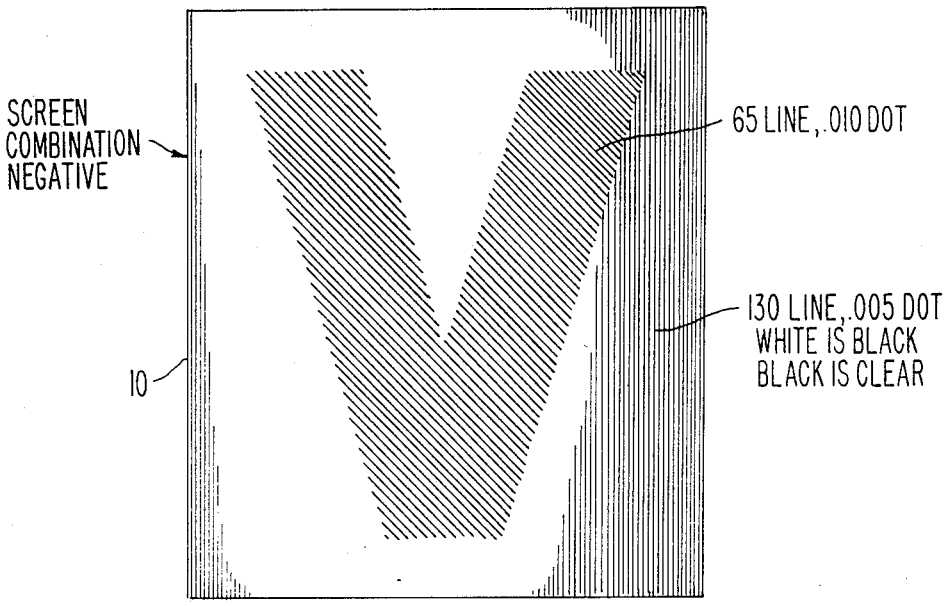
FIG. 2 is the first screen combinations shown in FIG. 1.
Figure 3:
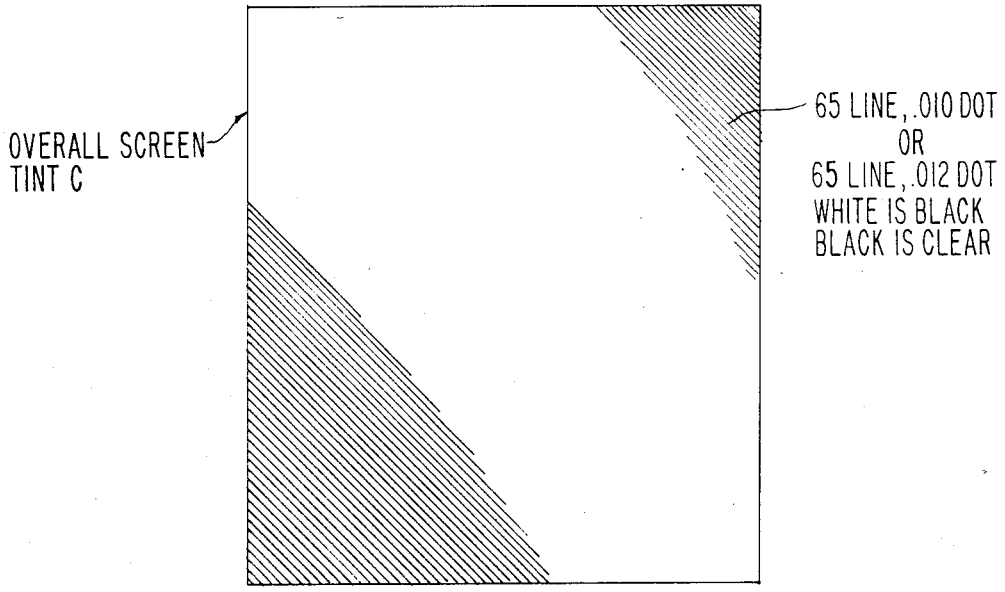
FIG. 3 is Overall Screen Tint C used in fabricating the first screen combination of FIG. 2.

Looking more specifically at first screen combination 10 of FIG. 1, more detail is shown in FIG. 2. For brevity, only the "V" of the word "VOID" is shown. First screen combination 10 is a composite negative which has a latent image of the 65 line dots covering the area of the "V", and 130 line dots covering the area of the background. The procedure for making the composite negative is as follows. The word "VOID" and the background are exposed on separate negatives and then combined to make the composite negative. The negative having the area "VOID" is made by laying an unexposed piece of film, emulsion up, on an exposure frame. It is covered with Overall Screen Tint C, shown in FIG. 3, with emulsion down. This set is overlayed with Negative Mask B, shown in FIG. 4, with emulsion down. Light passes through the clear area of Negative Mask B, through the unshadowed area of Overall Screen Tint C, to the emulsion layer of the unexposed film. This gives a latent image of the 65 line dots in the area of the "V". Development at this stage will give patterned blocks of 65 line dots which make the text visible, but without background dots. An emulsion to emulsion contact gives an emulsion down negative. A similar set of steps gives the background dots surrounding the text but on a separate piece of film. An emulsion to emulsion contact gives an emulsion down negative. Additional emulsion to emulsion exposures to another piece of film merge the two dot patterns into the composite negative screen combination 10.

To accomplish the above exposures, pin registration techniques are needed to get precisely aligned screen sets for the word and background combinations. The pin registration holes are shown as 30, 32, 34 in FIG. 1. The screen sets must be precisely aligned and punched so that the large dots and small dots fall into nearly exact alignment.

The steps are repeated to obtain second screen combination 12 having the word "VOID" with 65 line, 0.012 diameter dots in a background having 130 line, 0.006 diameter dots. The different sized dots give the extended range for protection in the color copier.

After first and second screen combination negatives 10 and 12 have been made they are ready to be used in the process to make the finished multi-tone negative 26. First camouflage pattern positive 14 and second camouflage pattern negative 16 are used to combine screen combination negatives 10 and 12 into a third negative 19. This negative will have 50% of its word and background area having 0.010 diameter word dots and 0.005 diameter background dots. The other 50% of the area will have 0.012 diameter word dots and 0.006 diameter background dots.

Figure 5:
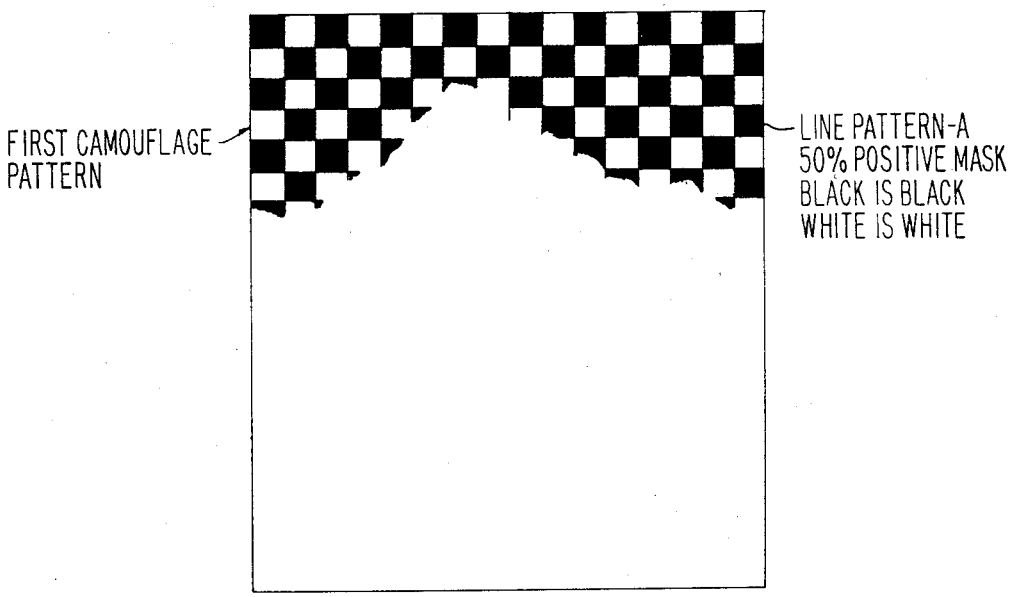
FIG. 5 is a detailed diagram of the first camouflage pattern positive of FIG. 1.
Figure 6:
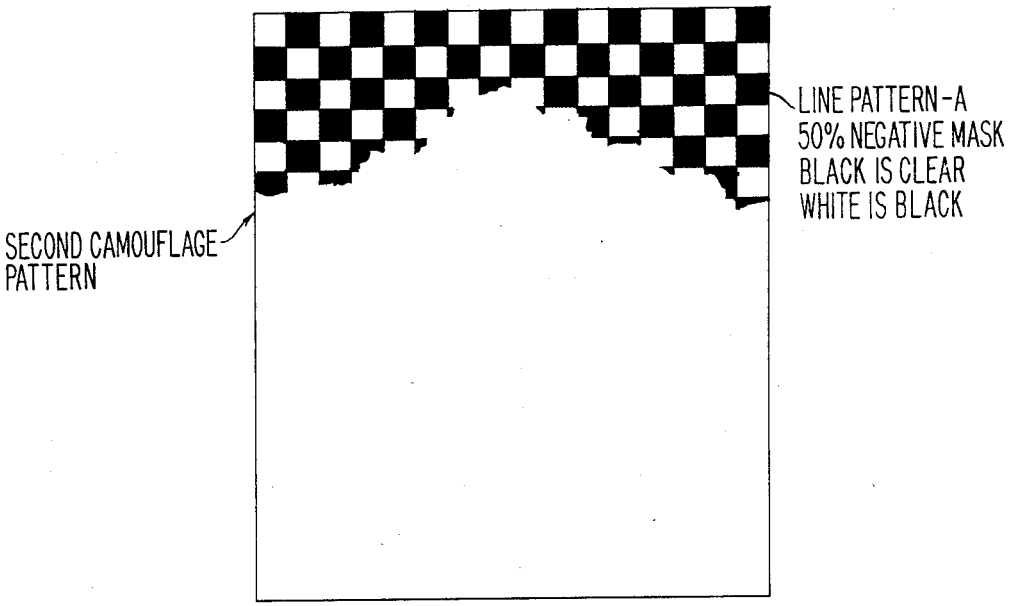
FIG. 6 is a detailed diagram of the second camouflage pattern negative of FIG. 1.
Figure 7:
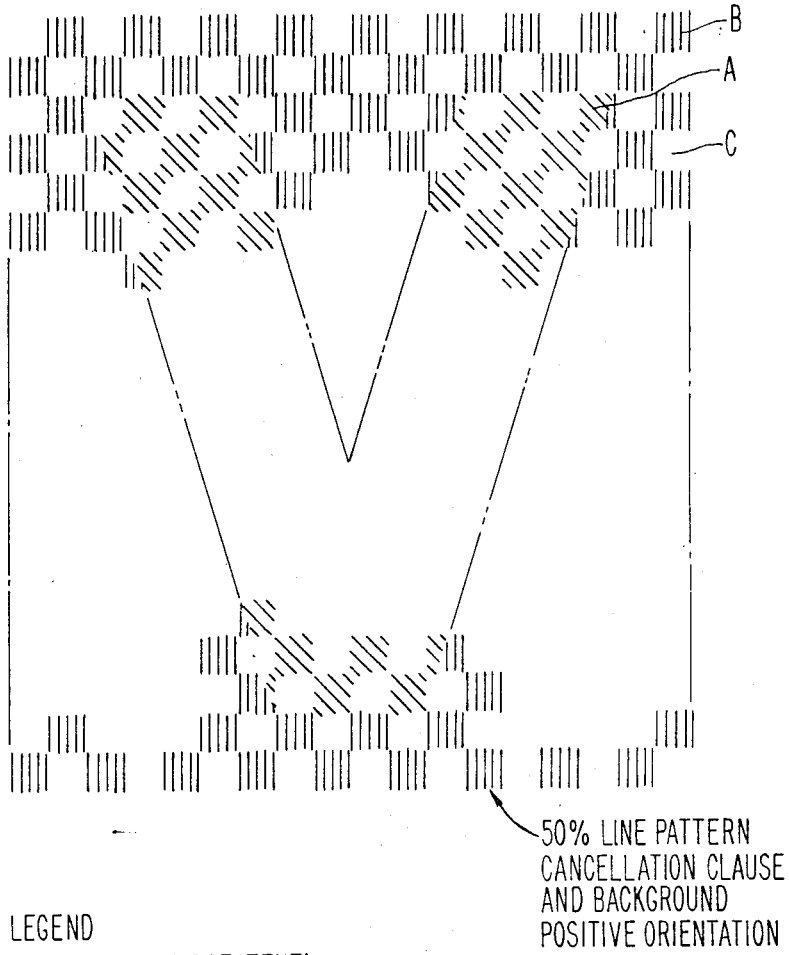
FIG. 7 is a detailed diagram of the results of the exposure of the first screen combination and first camouflage pattern positive of FIG. 1.

To accomplish this, first and second camouflage patterns 14, 16, shown in more detail in FIG. 5 and FIG. 6 respectively, are put in registration and holes punched in the two screens. A sheet of unexposed film with emulsion layer up is loaded onto registration pins. Next, first screen combination 10 is loaded on the registration pins followed by first camouflage pattern 14. The set is exposed for the time required to obtain the 0.010 and 0.005 dot sizes for the 65 and 130 line cancellation phrase and background. This is step 19 of FIG. 1. Screen combination 12 and camouflage pattern 14 are then removed. Development of the exposed film at this stage would show a pattern as in FIG. 7. However, the film is not developed at this stage.

Figure 8:
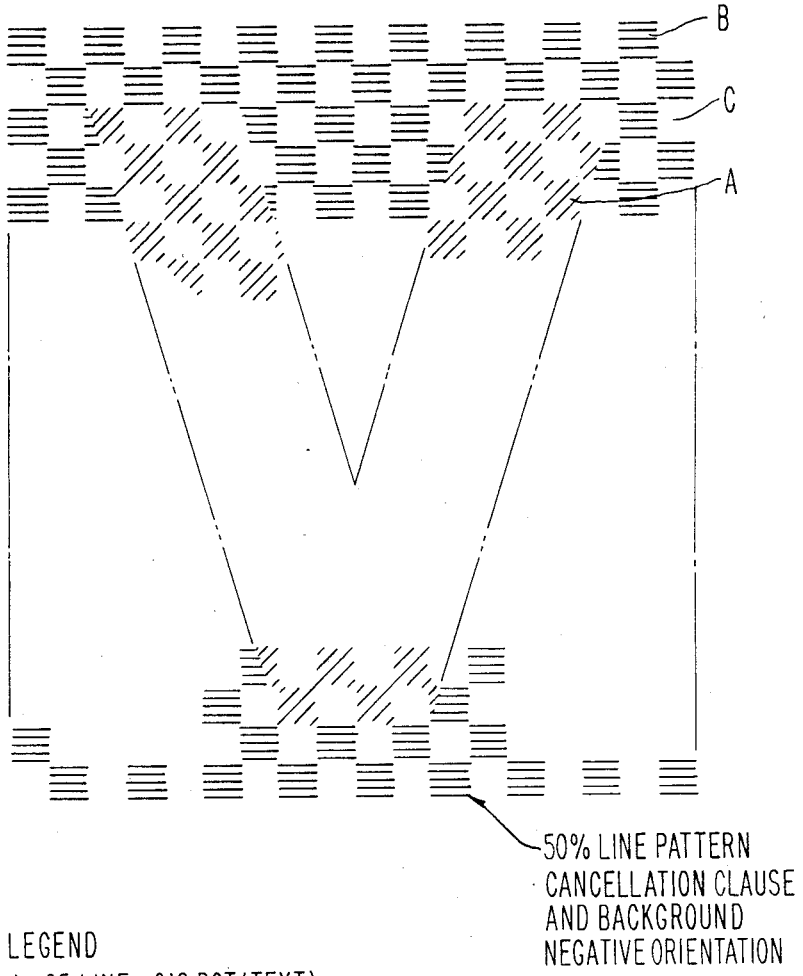
FIG. 8 is a detailed diagram of the results of the exposure of the second screen combination and second camouflage pattern negative of FIG. 1.

Repetition of the above steps using second screen combination 12 and second camouflage pattern 16 will give a film 21 with 0.012 and 0.006 dot sizes for the 65 and 130 line cancellation phrase and background. In this case, film 21 is developed to make a negative, a line pattern of which is shown in FIG. 8.

Figure 10:
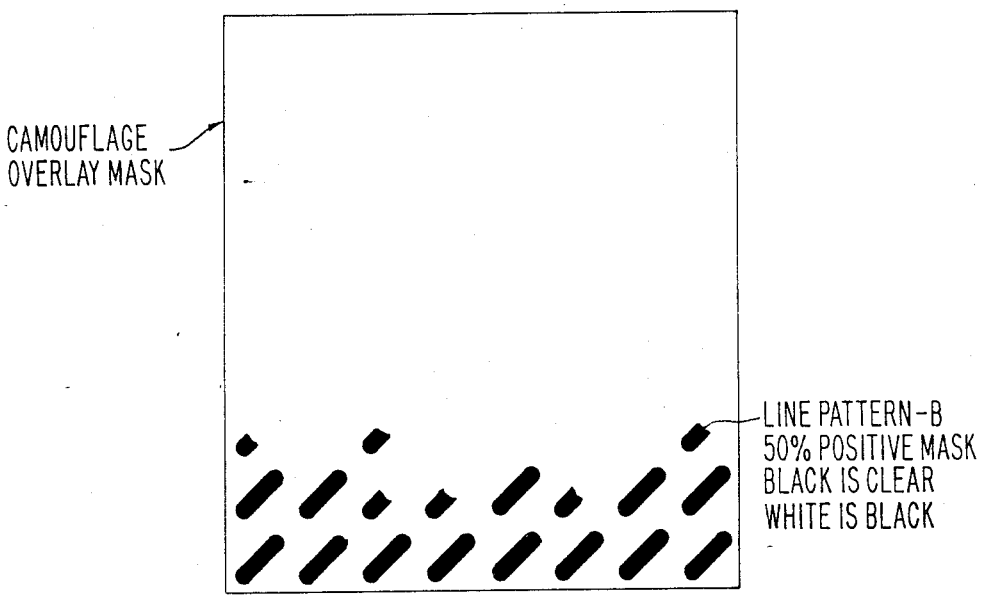
FIG. 10 is a detailed diagram of the camouflage overlay mask shown in FIG. 1.
Figure 9:
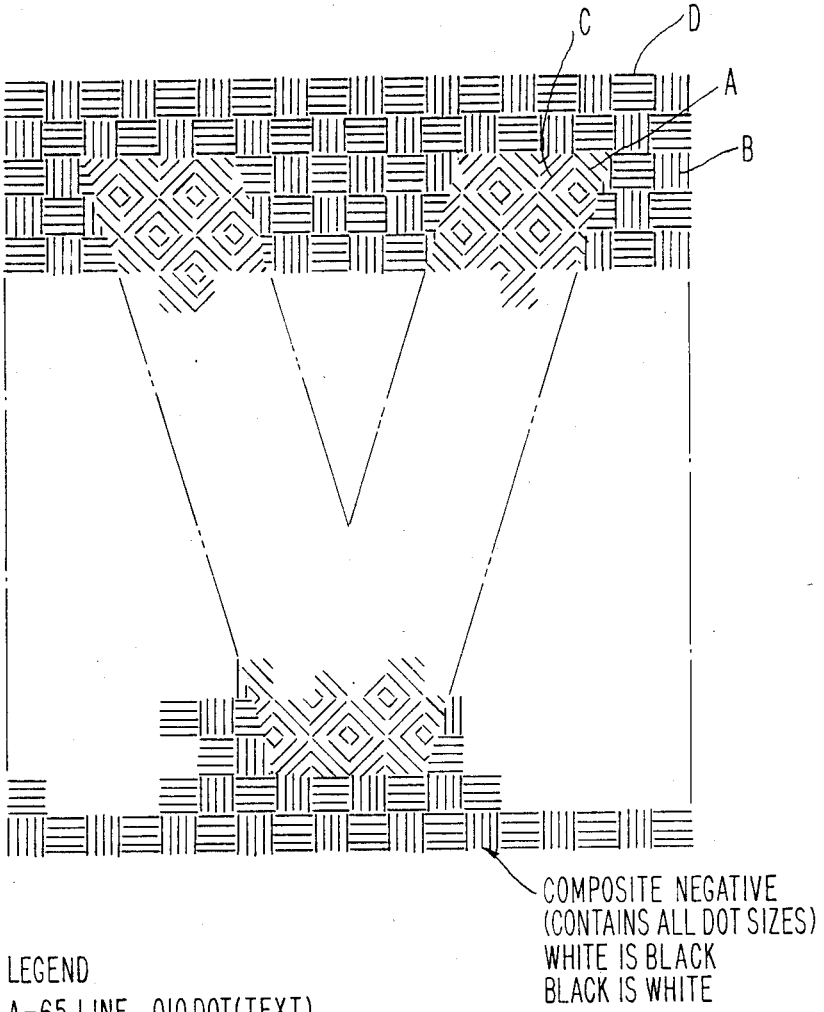
FIG. 9 is a detailed diagram of the composite negative shown in FIG. 1.

The latent image of film 19 is now overlayed on the registration pins by negative 21 and exposure 22 takes place. The result is an undeveloped latent image film 23 which is shown in FIG. 9. This figure shows the word having both the 65 line, 0.010 and 0.012 dots with the background having the 130 line, 0.005 and 0.006 dots. Development at this point would provide the multi-tone finished negative 26. However, prior to development, if the joints and areas of flat tone show too clearly, camouflage overlay mask 24, shown in FIG. 10, may be placed over the registration pins and exposed. This provides an additional level of camouflaging. Development would then provide the multi-tone finished negative 26, shown in FIG. 11.

An alternate and preferred way of obtaining composite film 23 avoids the step of having to develop film 21. Instead of developing film 21, second combination screen 12 and second camouflage pattern 16 are overlayed over the latent image of film 19. The set is then exposed to obtain the required 0.012 and 0.006 dot sizes for the 65 and 130 line cancellation phrase and background. As described previously, development will produce multi-tone finished negative 26. Camouflage overlay mask 24 may also be considered for use.

Figure 11:
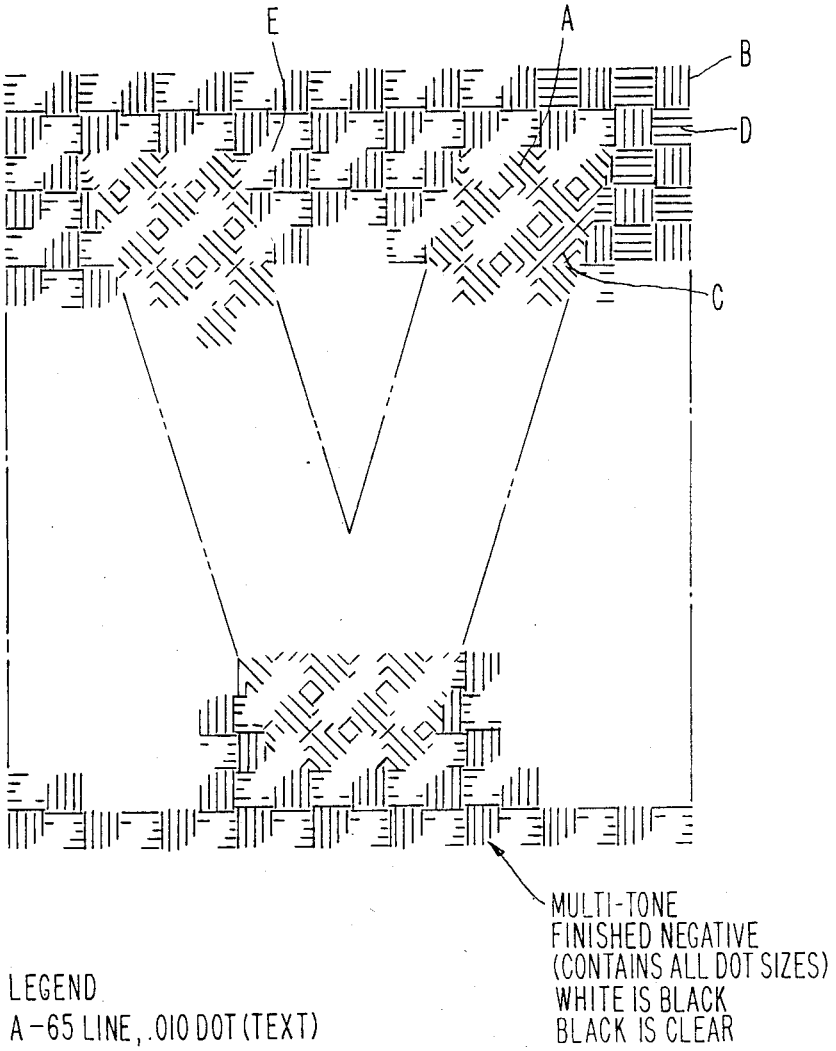
FIG. 11 is a detailed diagram of the multi-tone finished negative shown in FIG. 1.
Figure 12:
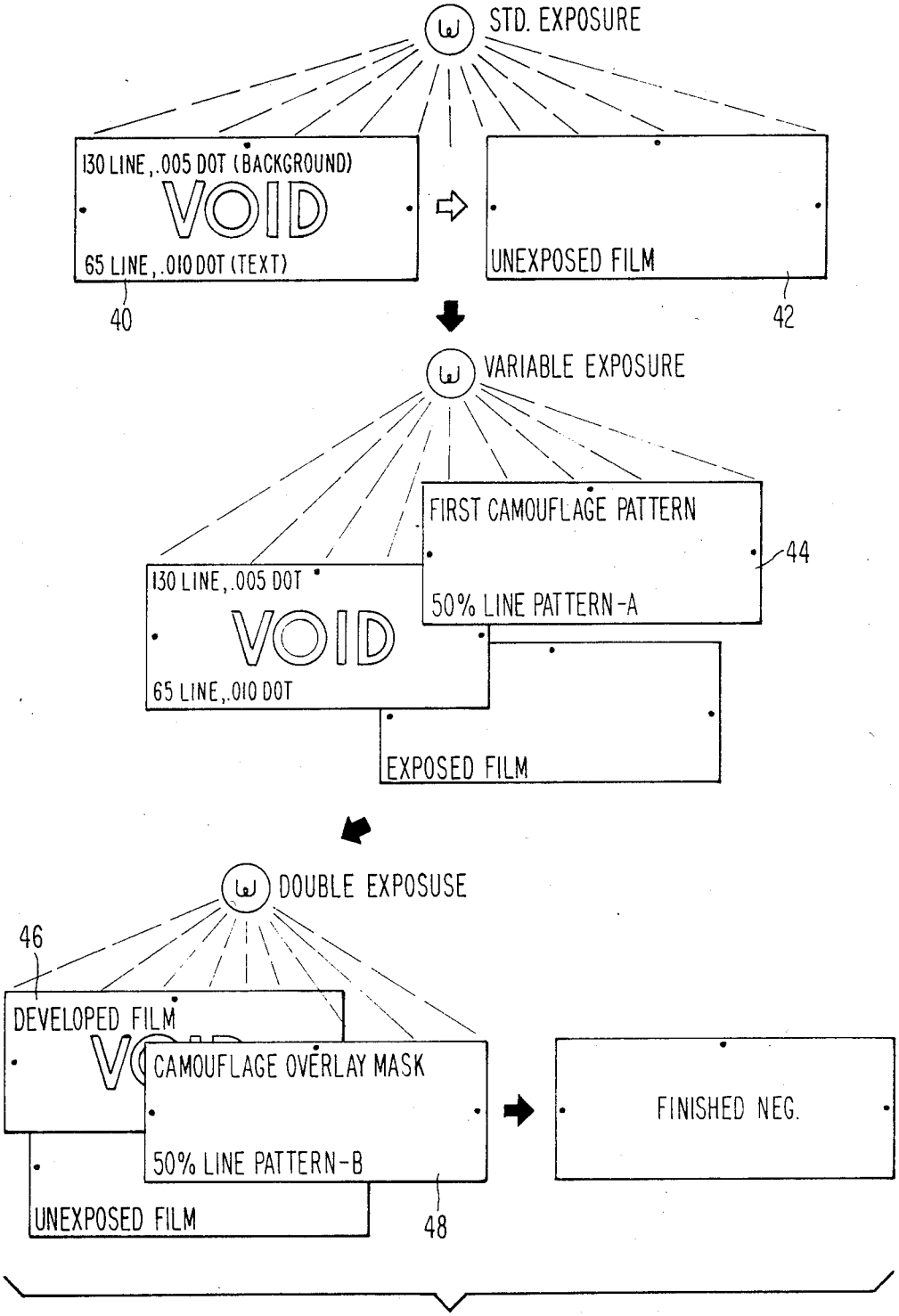
FIG. 12 is a block diagram of an alternative method of making a multi-tone finished negative.

The multi-tone finished negative of block 26 is shown in more detail in FIG. 11. A contact negative made from multi-tone composite negative 26 is then used to make test plates to give the finished print. The finished print appears identical to multi-tone finished negative 26 except that white is black and black is white. It should be noted that the checkerboard pattern would not be used in practice since it does not confuse the eye sufficiently, but it illustrates the method well. FIG. 12 shows an alternate method of making a multi-tone finished negative. This procedure has fewer steps and less precise registration requirements than the previous procedure. The second procedure depends on the fact that dot sizes are affected by continuing exposure. In other words, if a two minute exposure gives a 0.010 diameter dot, a five minute exposure may give a 0.011 dot. In some cases, a clear sheet of material may be placed over the receiving film to allow more light to get to the edges of the latent dot if larger sizes are needed.

The screen combination 40 may also be the same as screen combination 10 of FIG. 1 and may be fabricated in the same manner. The word "VOID" will have 65 line, 0.010 dots and the background will have 130 line, 0.005 dots.

To begin the process a piece of unexposed film 42 is put on registration pins. Screen combination 40 is then placed in registration over unexposed film 42. The set is exposed to get 65 line, 0.010 dots and 130 line, 0.005 dots. Next a camouflage pattern 44, similar to camouflage pattern 14 of FIG. 1, is overlayed on the set. This will shield 50% of the word and background from further exposure and maintain 0.010 and 0.005 dots in that area. The remaining area will continue being exposed to get a large dot. A clear piece of plastic installed over the unexposed film will assist in "spreading" the dots. This yields the composite negative 46 which contains all of the dot sizes. This composite negative will be similar to composite negative 23 of FIG. 1. A camouflage mask 48, similar to camouflage mask 24 of FIG. 1, will then be used after removal of camouflage mask 44. The result is a finished multi-tone composite negative 50, similar to multi-tone composite negative 26. of FIG. 1. A contact will give a negative suitable for making plates in running the finished prints.

Figure 4:
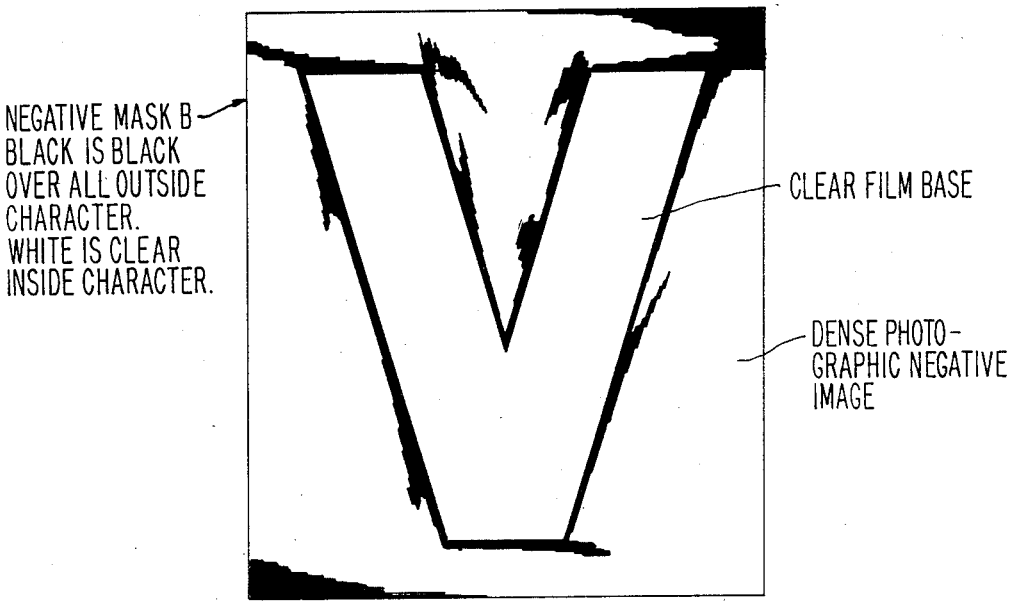
FIG. 4 is the Negative Mask B also used in fabricating the first screen combination of FIG. 1.
Figure 13:
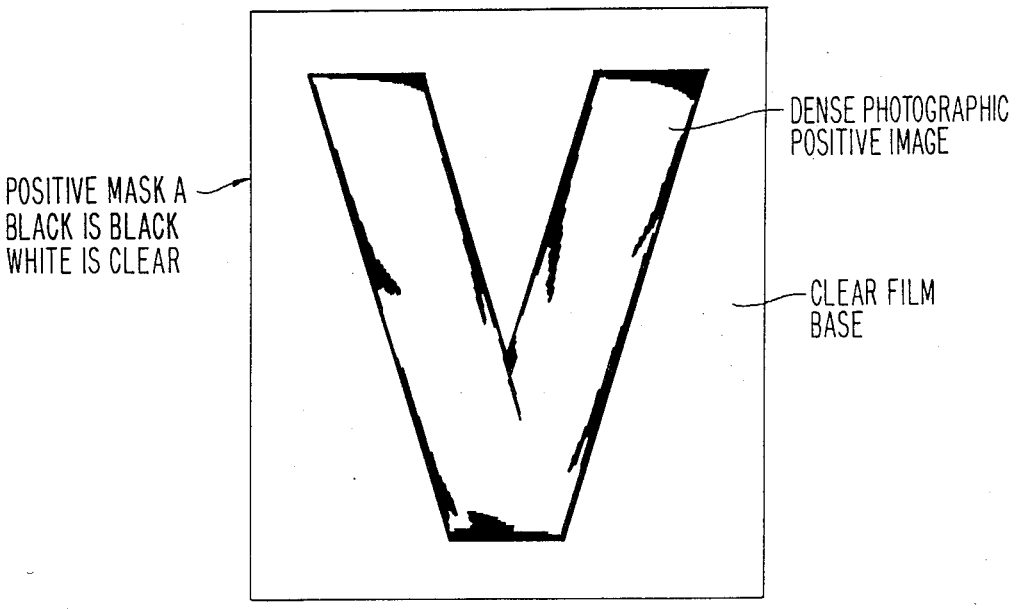
FIG. 13 is a detailed diagram of a positive mask used in an alternative method for making the first and second screen combinations.
Figure 14:
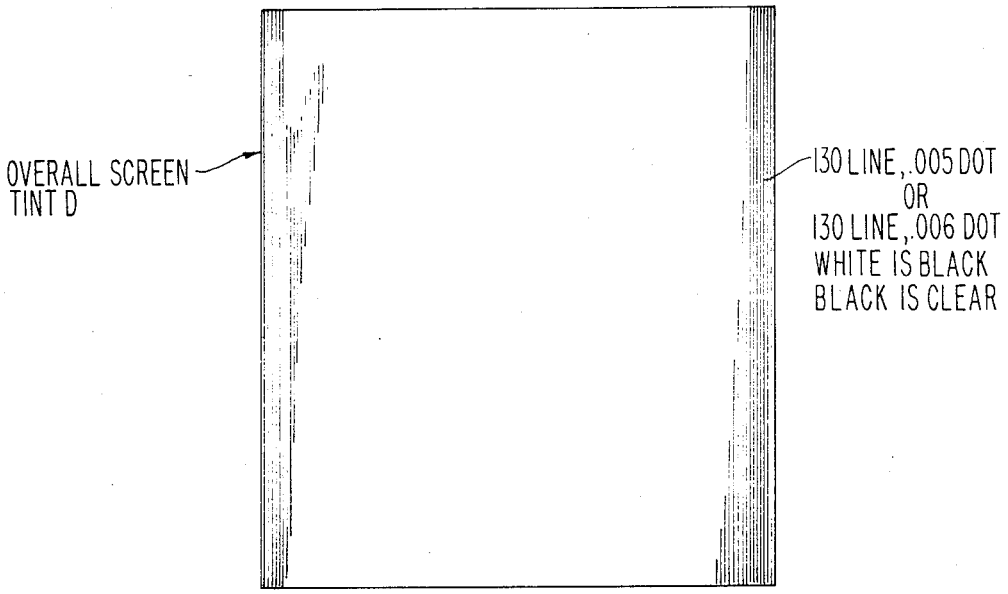
FIG. 14 is a detailed diagram of Overall Screen Tint D also used in making the first and second screen combinations.

An alternative method, also exists of making the screen combination negative 10, 40, shown respectively in FIGS. 1, 12. A suitably accurate pin register system allows a single receiving piece of film to have sequential placement of the various elements and exposure of the several sets of elements in appropriate order for appropriate times. Development of the exposed film gives screen combination 10, 40 in one development step. The method is as follows. Positive Mask A, shown in FIG. 13, and Negative Mask B, shown in FIG. 4, are aligned and registration holes are punched. The same is done with Overall Screen Tint C, shown in FIG. 3, and Overall Screen Tint D, shown in FIG. 14. An exposed film is put on the registration pins, emulsion side up. Screen Tint C is loaded, emulsion side down, over the unexposed film. Negative Mask B is then loaded, emulsion side down. The set is exposed to obtain 0.010 dot sizes for the 65 line screen. Negative Mask B and Screen Tint C are unloaded. Screen Tint D with emulsion side down is loaded over the film. Then Positive Mask A, emulsion side down, is loaded. The set is exposed to obtain 0.005 dot sizes for the 130 line dots. Development will give screen combination 10 of FIG. 1. The same procedure is used to obtain screen combination 12 of FIG. 1.

In conclusion, in the past basically two dot sizes and a single camouflaging pattern were used to remove dots to break up the flat tones and conceal the cancellation phrase. This provided a very satisfactory and practical solution to the problem, however, it has limitations as to range of settings and type of copiers. The present invention introduces a preferred method using two pairs of dot sizes in both word and background. The suggested combinations of dot size selections provides a document which performs over an extended range. The two dot pairs are combined in a randomized pattern using double exposure and masking techniques. An alternate method introduces two pairs of dot size using an appropriate mask to allow coninued exposure in parts of the image while protecting other parts from additional exposure. This continued exposure creates dots different in size from the protected dots, while avoiding the need for precise double exposure and masking.

What is claimed is:

1. A process for making a document which will be copy resistant in a color copier comprising:

placement of an unexposed photographic material on a set of registration pins;

placement of a first screen combination film having a first less than full tone image including a first cancellation phrase and a first background on said registration pins;

placement of a camouflage pattern film on said registration pins over said unexposed photographic material said first screen combination film;

exposure of said unexposed photographic material and said first screen combination and said first camouflage pattern;

replacement of said first screen combination and first camouflage pattern with a second screen combination film and the negative of the first camouflage pattern, said second screen combination film having a second less than full tone image including a second cancellation phrase and a second background; and, exposure of said unexposed photographic material second screen combination and the negative of the first camouflage pattern to generate a multi-tone composite negative.

2. The process of claim 1 in which said second screen combination and said negative of said first camouflage pattern after exposure are replaced with a camouflage overlay mask which is exposed, wherein said first and second cancellation phrases are substantially invisible to the human eye when viewed upon the original document but are readily apparent upon reproduction of said document upon a color copier.

3. A process for making a document which will be copy resistant in a color copier comprising:

placement of an unexposed photographic material on a set of registration pins;

placement of a first screen combination film having a first less than full tone image including a first cancellation phrase and a first background on said registration pins, exposure of said first screen combination and unexposed photographic material to obtain a first group of dots for said cancellation phrase and background;

placement of a first camouflage pattern film on said registration pins over said unexposed photographic material and said first screen combination to cover a portion of said first cancellation phrase and background dots;

exposure of said first screen combination film and first camouflage pattern to increase the size of said exposed background and cancellation phrase dots to form a second group of enlarged dots; and, said first and second groups of dots making up a multi-tone finished negative.

4. The process of claim 3 in which the film having the enlarged dots is covered by a camouflage overlay mask which is exposed wherein said first and second cancellation phrsaes are substantially invisible to the human eye when viewed upon the original document, but are readily apparent upon a reproduction of said document upon a color copier.

5. In a improved document for deterring nefarious xerographic reproduction on a color copier having a substrate on the surface of which is disposed a composite image containing a cancellation phrase substantially invisible to the human eye but reproducable on a color copier and a background pattern less reproducable on a color copier than said cancellation phrase, the improvement wherein said composite image on said substrate comprises a combination of a first composite image having a cancellation phrase and a background pattern of different tones and a second composite image having a cancellation phrase and a background pattern of different tones which tones are different from the tones forming said first composite image.

6. The improved document of claim 5 wherein the composite image on said substrate includes a combination of approximately 50% of said first composite image and 50% of said second composite image.

7. The improved document of claim 5 wherein portions of said first and second composite images are distributed across the surface of said substrate.

8. The improved document of claim 5 wherin a camouflage pattern overlies the combined composite image.

* * * * *